United States Patent [19]

Hynek

[11] Patent Number: 4,909,168

[45] Date of Patent: Mar. 20, 1990

[54] FITTING FOR ATTACHING BOOM ASSEMBLY TO MAST

[76] Inventor: Scott J. Hynek, 96 Washington Ave., Waltham, Mass. 02154

[21] Appl. No.: 168,425

[22] Filed: Mar. 15, 1988

[51] Int. Cl.[4] ..... B63H 9/10

[52] U.S. Cl. ..... 114/39.2; 114/89

[58] Field of Search ..... 114/89, 90, 97, 98, 114/39.2

[56] References Cited

U.S. PATENT DOCUMENTS

| | | | |
|---|---|---|---|
| 4,334,488 | 6/1982 | Jolivet | 114/39.2 |
| 4,424,759 | 1/1984 | Dolence | 114/97 |
| 4,587,916 | 5/1986 | Guerette | 114/39.2 |
| 4,674,428 | 6/1987 | Weber et al. | 114/39.2 |
| 4,679,518 | 6/1987 | Frank | 114/98 |
| 4,681,052 | 7/1987 | Nedoluha | 114/98 |

FOREIGN PATENT DOCUMENTS

| | | | |
|---|---|---|---|
| 3420289 | 4/1985 | Fed. Rep. of Germany | 114/39.2 |
| 2912868 | 10/1986 | Fed. Rep. of Germany | 114/98 |
| 3608529 | 10/1986 | Fed. Rep. of Germany | 114/98 |

*Primary Examiner*—Joseph F. Peters, Jr.
*Assistant Examiner*—Edwin L. Swinehart

[57] ABSTRACT

A device for rigidly but removably attaching the boom assembly, or wishbone (46), of a sail-powered vehicle to the mast (14). The device includes a tubular mast sleeve (15) that is slit in front, receptacles (16) for the forward ends of the booms (36,38), and a mechanism that permits the mast sleeve to deform so as to grip the mast but resists any other deformation.

9 Claims, 3 Drawing Sheets

FITTING FOR ATTACHING BOOM ASSEMBLY TO MAST

BACKGROUND

1. Field of Invention

The present invention relates to a device for attaching boom assemblies ("wishbones") to masts on sailboards or similar wind-powered vehicles.

2. Description of Prior Art

On a sailboard, a "wishbone" is a device for stretching the sail away from the mast into an aerodynamic shape. The boardsailor manipulates the wishbone to control the position and orientation of the sail and mast relative to the sailboard.

The wishbone generally consists of a front fitting and a rear fitting connected by two booms. Sometimes boom extension pieces are inserted between the booms and the rear fitting. The wishbone is usually attached to the mast by lashing its front fitting to the mast with a piece of line called an inhaul. The combination of front fitting and inhaul can be referred to as a "gooseneck," a term commonly applied to the fitting that attaches the boom to the mast on a conventional sailboat. The present invention, which replaces both the front fitting and the inhaul, and which is used only with a wishbone, can be referred to as a "wishbone gooseneck."

The attachment of wishbone to mast must resist any motion of the wishbone along the mast. It must also resist the tendency of the wishbone to rotate about its longitudinal axis as torque is applied to it when the boardsailor hangs from one of the booms.

Yet the wishbone should be attachable to the mast over a range of positions along the mast. It is also desirable that neither attaching nor detaching the wishbone and mast require great strength or dexterity.

A common method of attachment involves wrapping the inhaul around the mast several times and tying both ends of the inhaul to the front fitting. This is done with the wishbone roughly parallel to the mast. Subsequent rotation of the wishbone so that it is perpendicular to the mast stretches the inhaul and tightens this connection. If the inhaul was lashed tightly enough to begin with, the connection will now be tight enough so that the attachment is adequately rigid, until the inhaul either loosens or stretches. If the inhaul was lashed too tightly to begin with, rotating the wishbone to the perpendicular position can crush the mast, in part because the contact between the mast and the front fitting is insufficiently distributed. It is often difficult to untie the inhaul, for its knots tighten under use; yet it must be untied when detaching the boom and the mast or when adjusting the position of the boom on the mast.

Known in the art are several devices that provide simpler operation than do lashed inhauls.

U.S. Pat. No. 4,587,916 to Guerette (1986) shows a device in which the inhaul is replaced by a lever-operated, hook-clamping strap, which holds the mast against the crotch of a V-shaped front fitting. U.S. Pat. No. 4,424,759 to Dolence (1984) shows a device in which rotation of the wishbone compresses a split collar onto the mast. U.S. Pat. No. 4,679,518 to Frank (1987) shows a device in which rotation of a screw member deforms a split collar so that it clamps onto the mast. The devices of Guerette, Dolance, and Frank all tend to lessen their grip on the mast as outhaul tension is increased and the sail tends to pull the mast aft with respect to the device. This is because the strap or collar containing the mast tends to elongate fore and aft.

U.S. Pat. No. 4,674,428 to Weber et al. (1987) shows a front fitting consisting of a rigid split sleeve with a friction-reducing lining. This device grips the mast poorly if at all with the application of outhaul tension, because the split collar is rigid rather than flexible, and because of the friction-reducing lining. This device, as well as those of Guerrette, Dolance, and Frank, will deform under torsional loading, because they do not surround the mast with structural material capable of resisting such deformation. Under the loading of a boardsailor hanging from one of the booms, the uppper surfaces of Weber's split sleeve 90, Guerrette's strap 49, Dolance's mast collar 15, and Frank's clamping jaws 13 will no longer be planar; rather, these upper surfaces will assume the shape of the upper surface of a split lockwasher. This deformation permits the wishbone to rotate about its longitudinal axis, reducing the boardsailor's control over the position and orientation of the sail.

A device marketed under the trademark SURFCAT PRO SPORT (source unknown) utilizes a split collar clamped to the mast with five bolts and nuts. On the front of this split collar is a short horizontal bar connected to the collar by two vertical lugs. This bar mates with a hook connected to a V-shaped front fitting, the rear face of which closely conforms to the collar as the boom is rotated from parallel to the mast to perpendicular to it.

A device marketed under the trademark LINK (source unknown) consists of two hollow half-cylindrical pieces that are clamped to the mast by the rotation from vertical to horizontal of two hollow cylinders, connected to the front ends of the booms, about a horizontal shaft forward of the half-cylindrical pieces. Its clamping force is diminished, rather than fostered, by outhaul tension; outhaul tension deforms the wishbone so that it becomes shorter and wider, and increases the acute angle between the forward ends of the boom pieces, which decreases their clamping force on the mast.

OBJECTS AND ADVANTAGES

The present invention affords simplicity of operation, both in assembly and disassembly. It also affords substantial torsional rigidity. Further, it distributes the contact with the mast sufficiently that it cannot crush the mast.

Further objects and advantages will become apparent from the ensuing description and the accompanying drawings.

DRAWING FIGURES

DRAWING REFERENCE NUMERALS

6 wishbone gooseneck

Figure 1:
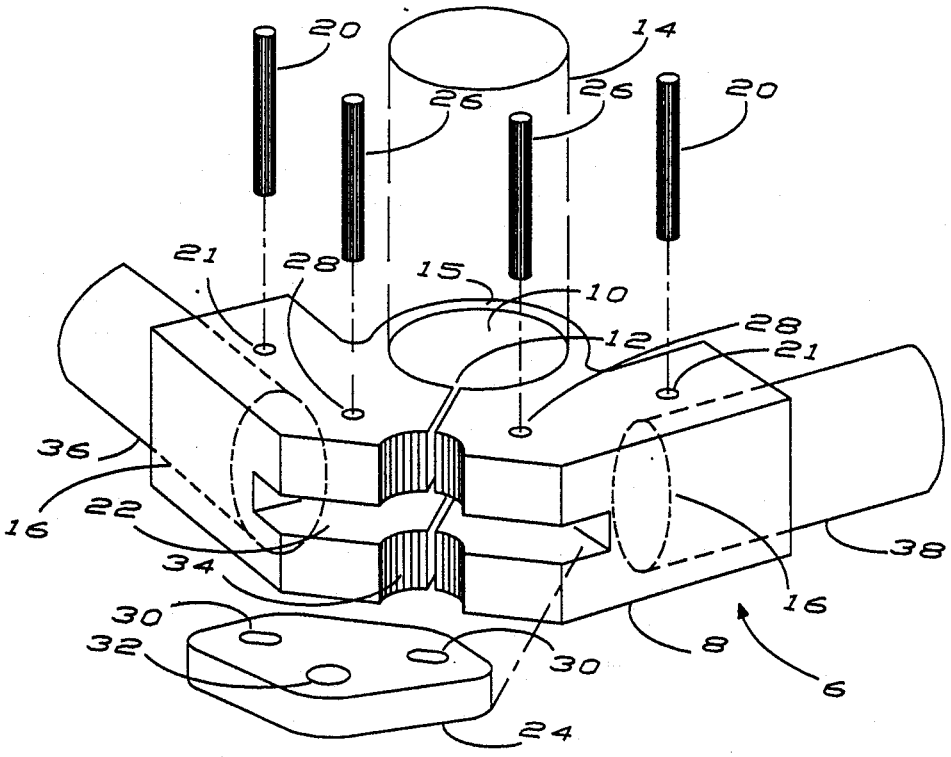
FIG. 1 is an exploded isometric view of the preferred embodiment of a wishbone gooseneck for a sailboard in accordance with my invention.

8 main body of wishbone gooseneck 10 vertical hole for mast
12 vertical slit
14 mast
15 mast sleeve
16 blind holes for boom ends
19 rivets to secure boom ends
20 pins to secure boom ends
21 round holes in main body
22 slot for flat key
24 flat key
26 pins to retain flat key
28 round holes in main body
30 oval-shaped holes in flat key
32 round hole for uphaul
34 semi-circular cutaway
36 starboard boom piece
38 port boom piece
40 wishbone tailpiece
42 sail
44 outhaul line
46 wishbone assembly

DESCRIPTION OF THE PREFERRED EMBODIMENT—FIGS. 1 AND 2

Referring to the drawings, FIG. 1 illustrates the preferred embodiment of a wishbone gooseneck in accordance with my invention for attaching a sail (not shown) to a mast (shown in broken lines at 14). The wishbone gooseneck comprises a main body 8 which contains a vertical hole 10 with a vertical slit 12. Slit 12 extends from the forward edge of hole 10 (the edge closer to the observer) to the forward surface of body 8. Mast 14 passes through hole 10. The portion of body 8 that surrounds hole 10 constitutes a mast sleeve 15. Main body 8 also contains two horizontal blind holes 16 into which the forward ends of starboard boom piece 36 and port boom piece 38 are inserted. Boom pieces 36 and 38 are conventional and are secured from twisting by pins 20 which are inserted into holes 21 in body 8.

The forward portion of body 8 contains a slot 22 into which is inserted a flat key 24. Key 24 is retained within slot 22 by two pins 26 which fit snugly within round holes 28 in body 8 and loosely within oval-shaped holes 30 in key 24. Key 24 fits just loosely enough within slot 22 as to permit it to have some lateral motion. The forward portion of key 24 contains a round hole 32 for attachment of an uphaul line (not shown). The forward surface of main body 8 contains a semi-circular cutaway 34 to accommodate the uphaul. Either body 8 or key 24, or both, can be made of a machinable, injection moldable plastic, such as acetal.

Figure 2:
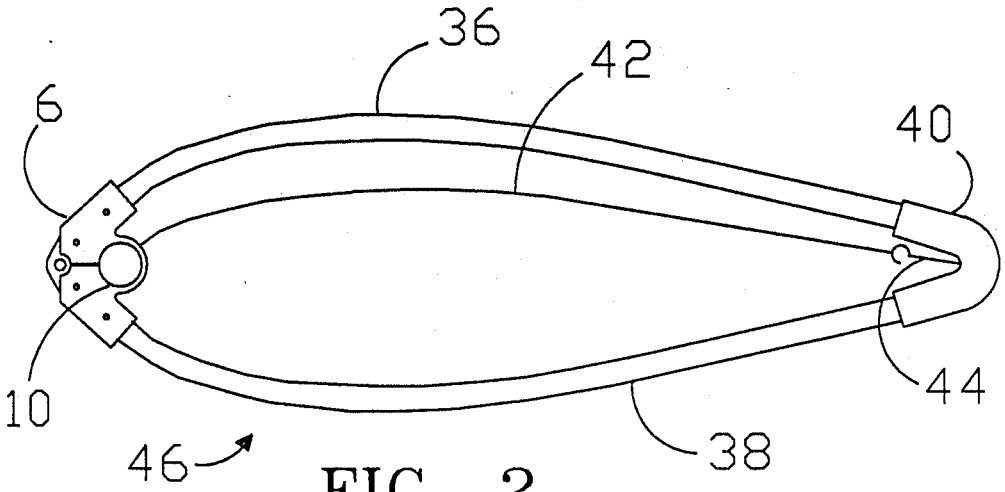
FIG. 2 is a plan view of the wishbone assembly.

FIG. 2, a top view, illustrates the position of wishbone gooseneck 6 within wishbone assembly 46. It also illustrates how an outhaul line 44 applies tension to a sail 42, which in turn pulls mast 10 aft with respect to wishbone gooseneck 6.

DESCRIPTION OF ALTERNATIVE EMBODIMENT

Figure 1A:
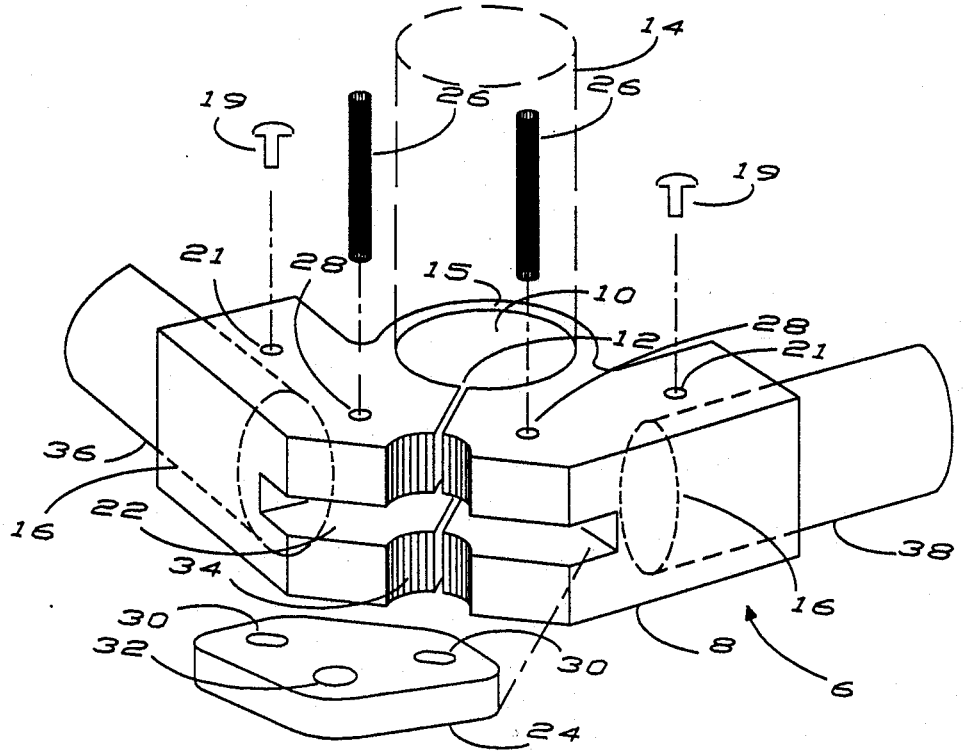
FIG. 1A is an exploded isometric view of an alternative embodiment of the wishbone gooseneck.

FIG. 1A illustrates an alternative embodiment of a wishbone gooseneck in accordance with my invention. Boom pieces 36 and 38 are secured from twisting by rivets 19 which are affixed within holes 21 in body 8.

OPERATION OF PREFERRED EMBODIMENT—FIGS. 3 AND 4

Figure 3:
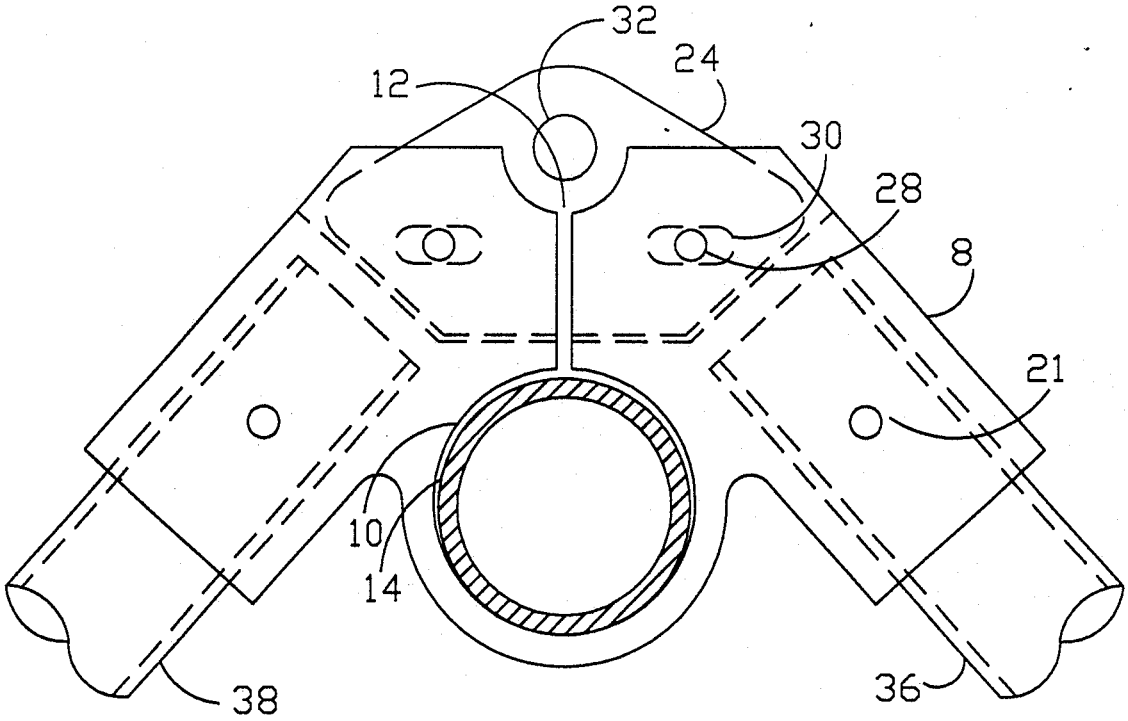
FIG. 3 is a plan view of the wishbone gooseneck in the absence of outhaul tension.
Figure 4:
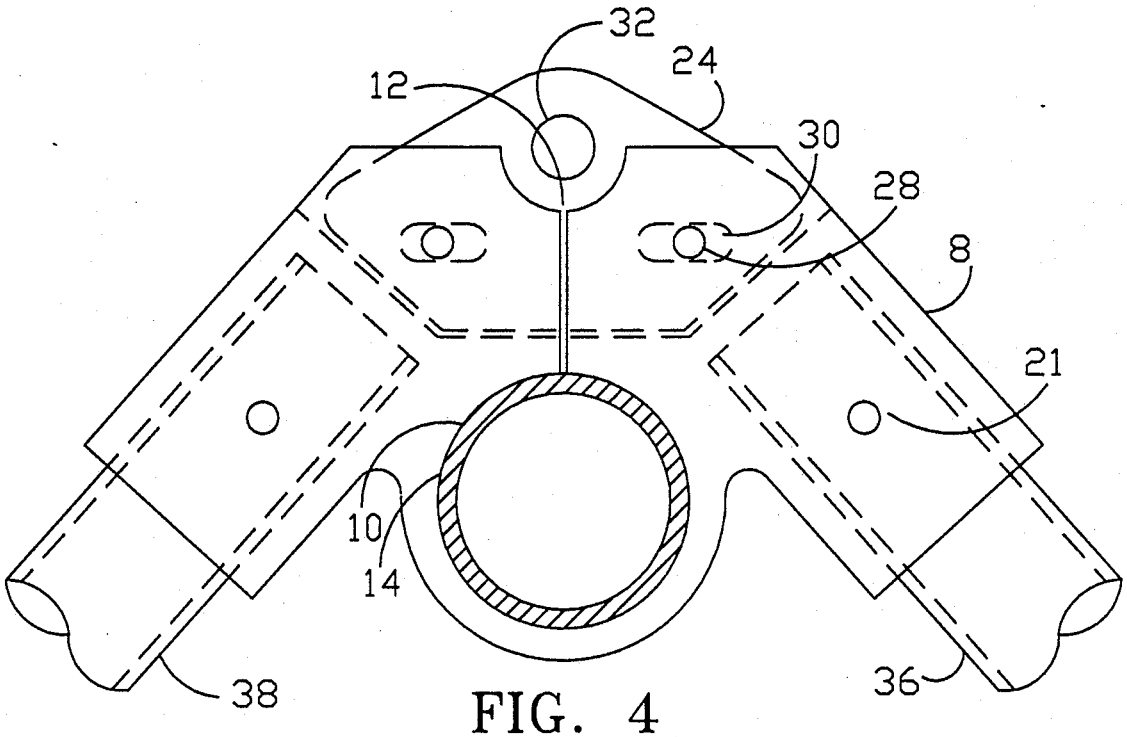
FIG. 4 is a plan view of the wishbone gooseneck in the presence of outhaul tension.

When rigging (assembling the sailboard), mast 14 is inserted into vertical hole 10 until wishbone gooseneck 6 is at the desired spot on the mast. FIG. 3 illustrates that, in the absence of outhaul tension, the lumen of vertical hole 10 is sufficiently larger in diameter than mast 14 that the wishbone gooseneck can slide easily over mast 14. When tension is applied to the outhaul, starboard boom piece 36 and port boom piece 38 move forward with relation to mast 14, deforming mast sleeve 15 so that it conforms to mast 14 and clamps tightly about it, as is illustrated in FIG. 4. This causes the portions of body 8 on each side of slit 12 to approach each other, reducing the width of slit 12. One or both sides of body 8 move laterally with respect to flat key 24.

When torque is applied to the wishbone via one of the boom pieces, key 24 within slot 22 prevents significant deformation of body 8, so that the upper surface of mast sleeve 15 remains substantially planar. Thus wishbone assembly 46 is prevented from rotating about its longitudinal axis, thereby preserving the boardsailor's control of the position and orientation of the sail.

Different boardsailors may wish to adjust the height of wishbone gooseneck 6 on mast 14 to accommodate wind conditions, boardsailor height, and personal preferences. To do so, they need only loosen outhaul line 44, slide wishbone gooseneck 6 along mast 14 as desired, and re-tension outhaul line 44.

CONCLUSION

Thus it has been shown that the wishbone gooseneck of the present invention permits simple assembly and disassembly of the wishbone to the mast; that it permits easy adjustment of the mast position at which the wishbone is attached; that the compressive load between the wishbone gooseneck and the mast is well distributed, making it unlikely that the mast can be crushed during assembly; and that it is structurally rigid enough to resist deformation, with attendant twisting of the wishbone, when torque is applied to the wishbone assembly.

While the above description contains many specificities, the reader should not construe these as limitations on the scope of the invention, but merely as exemplifications of the preferred embodiment thereof. Those skilled in the art will envision many other possible variations within its scope.

For example, skilled artisans will readily be able to change the dimensions and shapes of the preferred embodiment. They will also be able to make the wishbone gooseneck of alternative materials such as metal, wood, and other plastics. They can make variations on the manner in which the wishbone gooseneck attaches to the boom pieces; for example, the blind holes in which are inserted the boom pieces can be replaced by cylindrical shapes to be inserted into the hollow boom pieces. They can prevent the boom pieces from rotating with respect to the wishbone gooseneck by means other than pins. They can secure the flat key loosely within the slot by means other than round pins through oval-shaped holes in the key; these holes can be almost any shape as long as they permit some lateral movement of the key within the slot. They can substitute a transverse pin and hole for the transverse flat key and slot. They can remove some material that is structurally unnecessary from the preferred embodiment presented in the figures; for example, the portions of the main body that surrounds the blind holes for the boom pieces and themselves be cylindrical; also, lightening holes can be added to the flat key without making it significantly weaker. Also, the portions of the main body that surround the blind holes for the boom pieces can be non integral with the mast sleeve.

Accordingly, the reader is requested to determine the scope of the invention by the appended claims and their legal equivalents, and not by the example which has been given.

What I claim is:

1. A device for rigidly and removably attaching a wishbone to a mast on a sail-powered vehicle, comprising:

a. a mast sleeve comprising a generally tubular member that is slit in the front, the lumen of said sleeve being sized to slide easily on said mast when said mast is inserted into said lumen, said sleeve being sufficiently flexible that said sleeve can be compressed to narrow the width of said slit sufficiently that said sleeve will clamp about said mast and prevent itself from sliding on said mast, b. a pair of rear facing boom receptacles attached to said mast sleeve, and c. transversely sliding means connected across said slit for permitting the diameter of said lumen of said mast sleeve to be altered while resisting other deformation of said mast sleeve, said transverely sliding means comprising a flat key and a transverse slot.

2. The device of claim 1 wherein said boom receptacles and said mast sleeve are an integral one-piece assembly.

3. The device of claim 1 wherein said boom receptacles are rearwardly divergent.

4. The device of claim 1 wherein said boom receptacles contain pin means for retaining said booms.

5. The device of claim 1 wherein said boom receptacles contain rivet means for retaining said booms.

6. A device for rigidly and removably attaching a wishbone to a mast on a sail-powered vehicle, comprising:

a. a mast sleeve comprising a generally tubular member that is slit in the front, the lumen of said sleeve being sized to slide easily on said mast when said mast is inserted into said lumen, said sleeve being sufficiently flexible that said sleeve can be compressed to narrow the width of said slit sufficiently that said sleeve will clamp about said mast and prevent itself from sliding on said mast, b. a pair of rear facing boom receptacles attached to said mast sleeve as an integral one-piece assembly, and c. a transverse key and a slot connected across said slit for permitting the diameter of said lumen of said mast sleeve to be altered while resisting other deformation of said mast sleeve.

7. The device of claim 6 wherein said boom receptacles are rearwardly divergent.

8. The device of claim 6 wherein said boom receptacles contain pin means for retaining said booms.

9. The device of claim 6 wherein said boom receptacles contain rivet means for retaining said booms.

* * * * *